US007418220B2

(12) United States Patent
Shiraishi et al.

(10) Patent No.: US 7,418,220 B2
(45) Date of Patent: Aug. 26, 2008

(54) IMAGE RECORDING APPARATUS

(75) Inventors: Yoshinori Shiraishi, Tenri (JP); Masato Tamehira, Nara (JP); Junya Masuda, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 226 days.

(21) Appl. No.: 11/465,830

(22) Filed: Aug. 21, 2006

(65) Prior Publication Data

US 2007/0077088 A1 Apr. 5, 2007

(30) Foreign Application Priority Data

Aug. 25, 2005 (JP) ..... 2005-244157

(51) Int. Cl.
*G03G 15/00* (2006.01)

(52) U.S. Cl. ..... 399/110; 399/113; 399/124

(58) Field of Classification Search ..... 399/107, 399/108, 110, 113, 114, 124
See application file for complete search history.

(56) References Cited

U.S. PATENT DOCUMENTS 5,797,068 A 8/1998 Otsuki et al.
6,708,011 B2 * 3/2004 Nomura et al. ..... 399/110
7,127,195 B2 * 10/2006 Kimura et al. ..... 399/116
7,277,661 B2 * 10/2007 Kim et al. ..... 399/113
7,349,650 B2 * 3/2008 Sunohara ..... 399/124

FOREIGN PATENT DOCUMENTS

JP 09-134050 5/1997
JP 2004-053653 2/2004

* cited by examiner

*Primary Examiner*—Hoan H Tran
(74) *Attorney, Agent, or Firm*—Renner, Otto, Boisselle & Sklar, LLP

(57) ABSTRACT

An image recording apparatus includes a sheet transport path, a first unit, and a second unit. The sheet transport path guides a sheet from a sheet feeding section, through an image recording section, to a sheet output section. The sheet transport path includes a first path and a second path. The first unit is mounted detachably in a housing. The first unit is detached from the housing by being moved in a first direction toward the front of the housing. In the first unit, the first path is positioned. The second unit is mounted detachably in the first unit. The second unit is detached from the first unit by being moved in a second direction perpendicular to the first direction with the first unit detached from the housing. In the second unit, the second path is positioned.

5 Claims, 11 Drawing Sheets

IMAGE RECORDING APPARATUS

CROSS REFERENCE

This Nonprovisional application claims priority under 35 U.S.C. § 119(a) on Patent Application No. 2005-244157 filed in Japan on Aug. 25, 2005, the entire contents of which are hereby incorporated by reference.

BACKGROUND OF THE INVENTION

The invention relates to an image recording apparatus for recording an image on a sheet being transported on a sheet transport path.

In electrophotographic image recording apparatus, a sheet is fed from a sheet feeding tray to an image recording section where an image is formed on the sheet. Then the sheet is output to a sheet output tray. A sheet may become jammed on its way on a sheet transport path.

A sheet jam is likely to occur particularly in the image recording section. This is because a sheet tends to be curled while undergoing various processes in the image recording section such as: a developer-image transfer process performed by a transfer device; or a fusing process performed by a fusing device.

A sheet jam is also likely to occur in a reversing transport path on which, in duplex image formation (an image is formed on both sides of a sheet), a sheet with an image formed on a first side is reversed and transported back to the image recording section. This is because the duplex image formation involves a sheet passing through many bifurcations of the sheet transport path.

In the event of a sheet jam, image recording apparatus suspend an image forming process until all sheets present on the sheet transport path are removed. JP H09-134050A discloses that a sheet jammed in the image recording section is removed by pulling forward the image recording section out of the image recording apparatus and by opening a side wall, or the like, of the section to expose the sheet transport path.

The configuration as disclosed by the prior art apparatus, however, involves a small level of exposure of a portion of the sheet transport path located in the image recoding section, even with the image recording section pulled out and the side wall opened. Thus, this configuration renders it hard for a user to remove a jammed sheet. In particular, recent image recording apparatus with high functionality have a complex configuration that renders it hard to provide a large space for removing a jammed sheet.

In consecutive image formation that involves a plurality of sheets present on the sheet transport path, a user is necessitated, if only a small level of exposure of sheet transport path is available, to open side walls or the like of different portions of the image recording section in order to check if all the sheets are removed from the sheet transport path.

In light of the foregoing, a feature of the invention is to provide an image recording apparatus having a simplified configuration that provides a large space for removing a sheet from the sheet transport path in the event of trouble such as a sheet jam.

SUMMARY OF THE INVENTION

An image recording apparatus includes a sheet transport path, a first unit, and a second unit. The sheet transport path guides a sheet from a sheet feeding section, through an image recording section, to a sheet output section. The sheet transport path includes a first path and a second path. The first unit is mounted detachably in a housing. The first unit is detached from the housing by being moved in a first direction toward the front of the housing. The first path is positioned in the first unit. The second unit is mounted detachably in the first unit. The second unit is detached from the first unit by being moved in a second direction perpendicular to the first direction with the first unit detached from the housing. The second path is positioned in the second unit.

DETAILED DESCRIPTION OF THE INVENTION

Image recording apparatus according to preferred embodiments of the invention will be described below with reference to the accompanying drawings.

Figure 1:
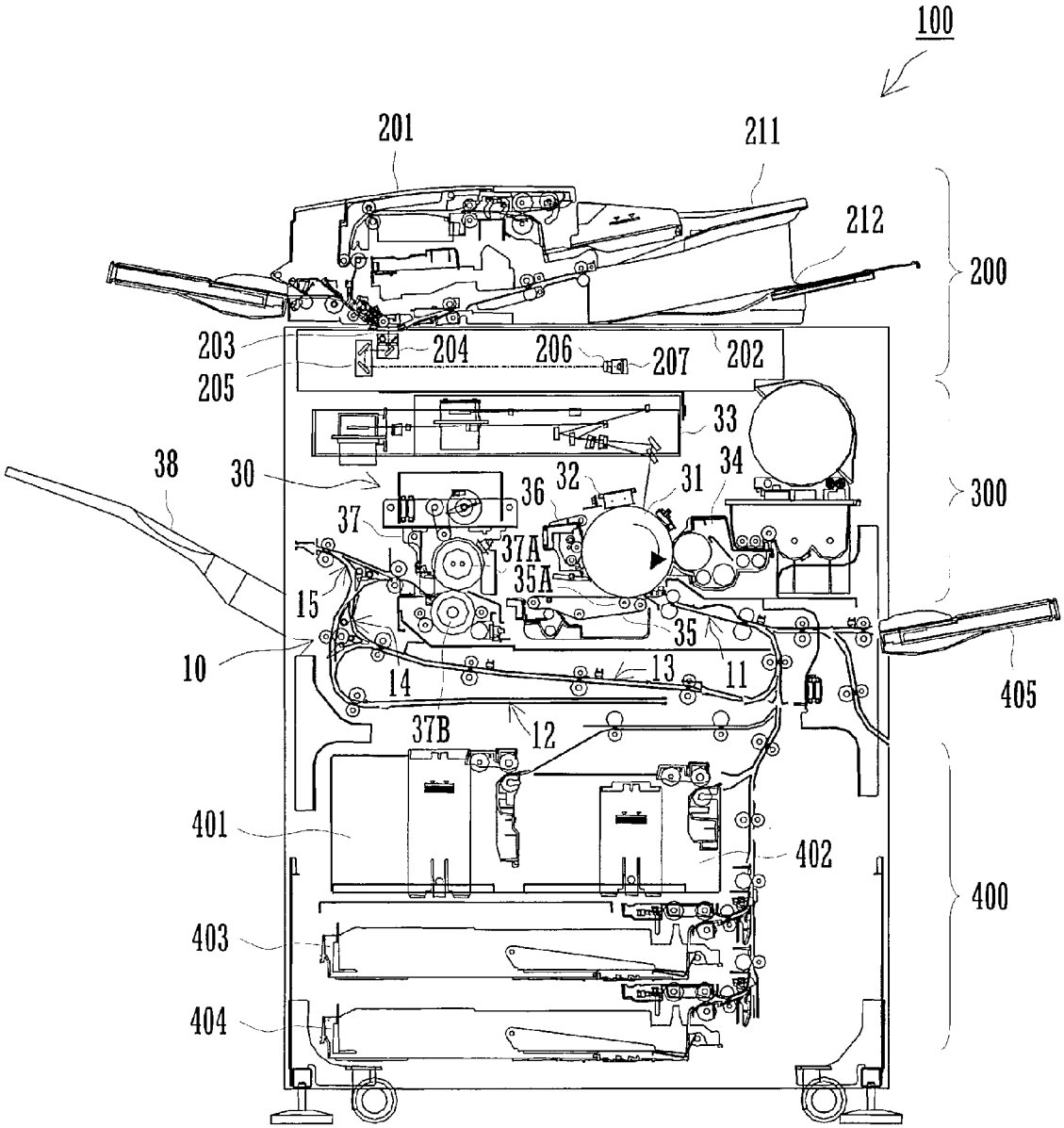
FIG. 1 is a schematic front cross-sectional view illustrating a configuration of an image recording apparatus according to an embodiment of the invention.

FIG. 1 is a schematic front cross-sectional view illustrating a configuration of an image recording apparatus according to an embodiment of the invention, such as an apparatus 100. The apparatus 100 includes an image reading unit 200, an image forming unit 300, and a sheet feeding unit 400.

The unit 200 has an automatic document feeder (ADF) 201, a first document platen 202, a second document platen 203, a first mirror base 204, a second mirror base 205, a lens 206, and a charge coupled device (CCD) 207.

The ADF 201 feeds an original document, sheet by sheet, from a document tray 211 through the second document platen 203 to a first output tray 212. The ADF 201 is mounted so as to be pivotable about a rear-end pivot between an open position and a closed position. In the closed position, the ADF 201 covers the platen 202. The ADF 201 is pivoted upward to the open position to expose the platen 202, so that a user can place an original document manually on the platen 202.

Each of the platens 202 and 203 includes a hard glass plate.

The bases 204 and 205 are provided below the platens 202 and 203 so as to be movable horizontally. The base 205 moves half as fast as the base 204. On the base 204, a light source and a first mirror are mounted. On the base 205, a second mirror and a third mirror are mounted.

In reading an image of original document that is being transported by the ADF 201, the base 204 is held still below the platen 203. While passing on the platen 203, an original document is irradiated with light from the light source. The reflected light is in turn reflected from the first mirror to the base 205.

In reading an image of original document placed on the platen 202, the bases 204 and 205 are moved horizontally below the platen 202. An original document placed on the platen 202 is irradiated with light from the light source. The reflected light is in turn reflected from the first mirror to the base 205.

Regardless of whether an original document is fed by the ADF 201 or placed on the platen 202, thus, the reflected light from the original document is in turn reflected from the second and third mirrors, and then strikes the CCD 207 through the lens 206.

The CCD 207 outputs electric signals according to an amount of the reflected light from the original document. The electric signals are input to the image forming unit 300 as image data.

The unit 300 is provided with an image recording section 30. The section 30 includes a photoreceptor drum 31, a charging device 32, an exposure device 33, a developing device 34, a transfer belt 35, a cleaner 36, and a fusing device 37.

The drum 31, which has an outer photoreceptive surface, is rotatable in a direction indicated by an arrow. The charging device 32 applies, to the surface of the drum 31, such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. The device 33 has a polygon mirror through which to scan the drum 31 axially with a laser light modulated according to image data. Alternatively, an exposure device provided with an array of light emitting elements such as ELs or LEDs may be used as the device 33.

The developing device 34 supplies toner to the surface of the drum 31 and develops the electrostatic latent image into a toner image.

Under the drum 31, the transfer belt 35 is looped over a plurality of rollers. The belt 35 has a resistance of $1*10^9$ Ω·cm to $1*10^{13}$ Ω·cm. Inside the loop of the belt 35, a transfer roller 35A is provided so as to be pressed against the drum 31 through the belt 35. A predetermined amount of transfer voltage is applied to the roller 35A, so that a toner image is transferred from the drum 31 to a sheet that passes between the belt 35 and the drum 31. The belt 35 and the roller 35A are elements of a transfer device of the invention.

The cleaner 36 removes residual toner that remains on the drum 31 after a toner image is transferred from the drum 31 to a sheet.

The fusing device 37 has a heat roller 37A and a pressure roller 37B. The roller 37A is heated, by an internal heater, to a sufficient temperature to melt toner. The roller 37B is pressed against the roller 37A at a predetermined pressure. The device 37 heats and pressurizes a sheet passing between the rollers 37A and 37B, thereby firmly fixing a toner image to the sheet. After passing through the device 37, a sheet is output to a second output tray 38 mounted on a side surface of the apparatus 100. The tray 38 corresponds to the sheet output section of the invention.

The sheet feeding unit 400 has sheet cassettes 401, 402, 403, and 404, and a manual sheet feeding tray 405. Each of the cassettes 401 to 404 holds a plurality of sheets of the same size. The tray 405 is provided for holding sheets of sizes and types that are used infrequently.

The unit 400 feeds sheets, one by one, from any one of the cassettes 401 to 404 and the tray 405. A sheet fed by the unit 400 is transported to the image recording section 30 along a sheet transport path 10 to be described below.

Figure 2:
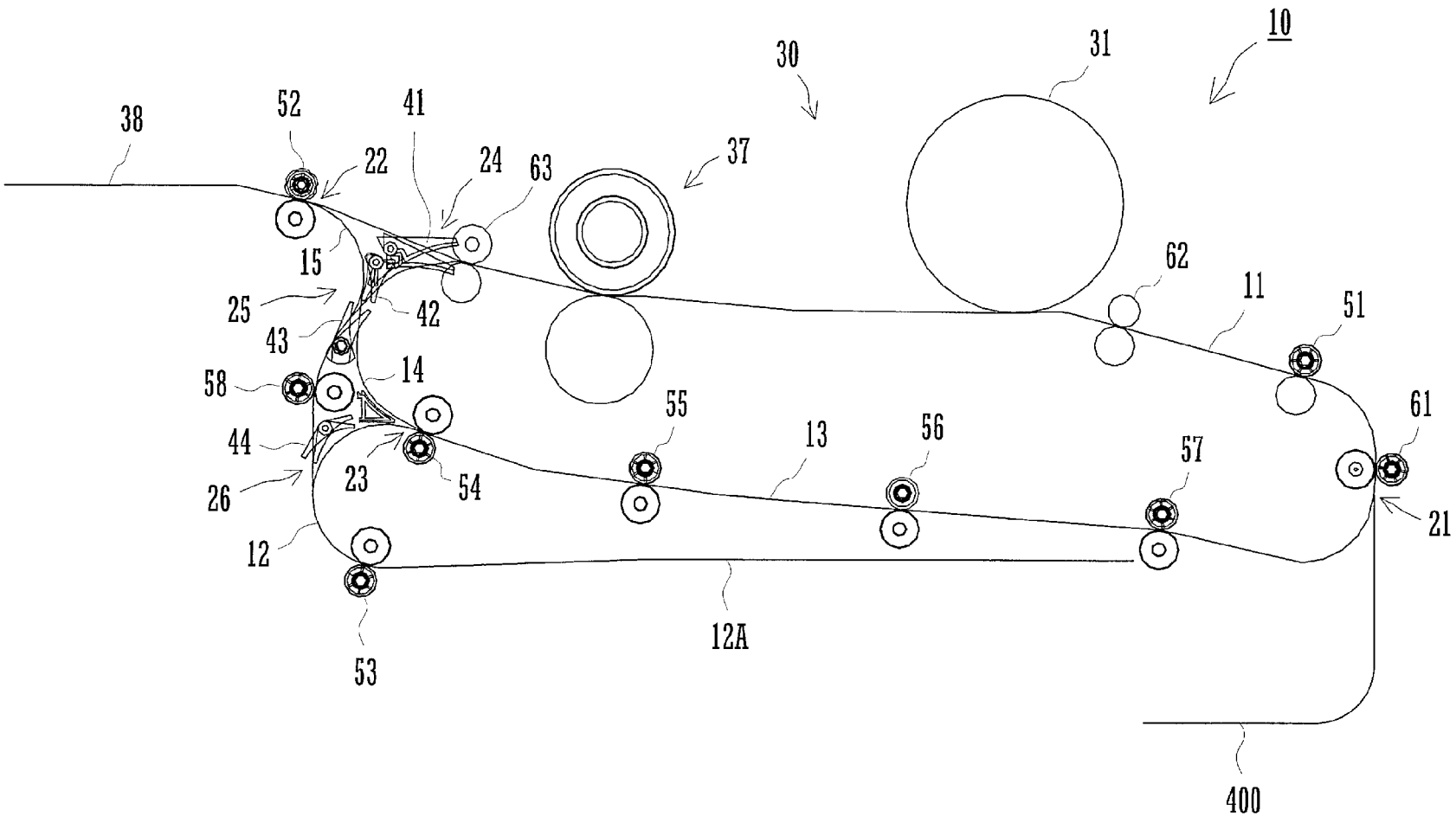
FIG. 2 is a diagram illustrating a configuration of a sheet transport path provided in the apparatus.

FIG. 2 is a diagram illustrating a configuration of the sheet transport path 10. The path 10 is provided inside the image forming unit 300. The path 10 includes a first path 11, a second path 12, a third path 13, a fourth path 14, and a fifth path 15.

The first path 11 leads from the unit 400 to the tray 38, through a first confluence 21, the section 30, a first bifurcation 24, and a second confluence 22 in that order. Arranged along the path 11 are transport rollers 61, 62, and 63, a registration roller 51, and an output roller 52. The transport rollers 61 to 63, the registration roller 51, and the output roller 52 are driven by a first motor (not shown).

A portion of the path 11 located in the section 30 is in an approximately horizontal position. In the portion, the belt 35 is arranged for stable transfer of toner image from the drum 31 to a sheet and for stable transport of a sheet with an pre-fusion toner image electrostatically attracted thereto.

The first bifurcation 24 is located between the section 30 and the tray 38. The second path 12 leads from the bifurcation 24 to a switchback section 12A, through a second bifurcation 25 and a third bifurcation 26 in that order. The section 12A is located below and parallel to the portion of the path 11 located in the section 30. The section 12A transports a sheet forwards and backwards therealong. Along the path 12, there are provided reversing rollers 53 and 58. The rollers 53 and 58 are selectively driven in a frontward direction or a backward direction through a first clutch (not shown) by a second motor (also not shown).

The third path 13 leads from the third bifurcation 26 to the first confluence 21 through a third confluence 23. The path 13 is located between the section 12A and the portion of the path 11 located in the section 30. Along the path 13, transport rollers 54, 55, 56, and 57 are arranged. The rollers 54 to 57 are selectively driven in a frontward direction or a backward direction through a second clutch (not shown) by a third motor (also not shown).

The fourth path 14 leads from the bifurcation 25 to the confluence 23. The fifth path 15 leads from the bifurcation 25 to the confluence 22.

Figure 3:
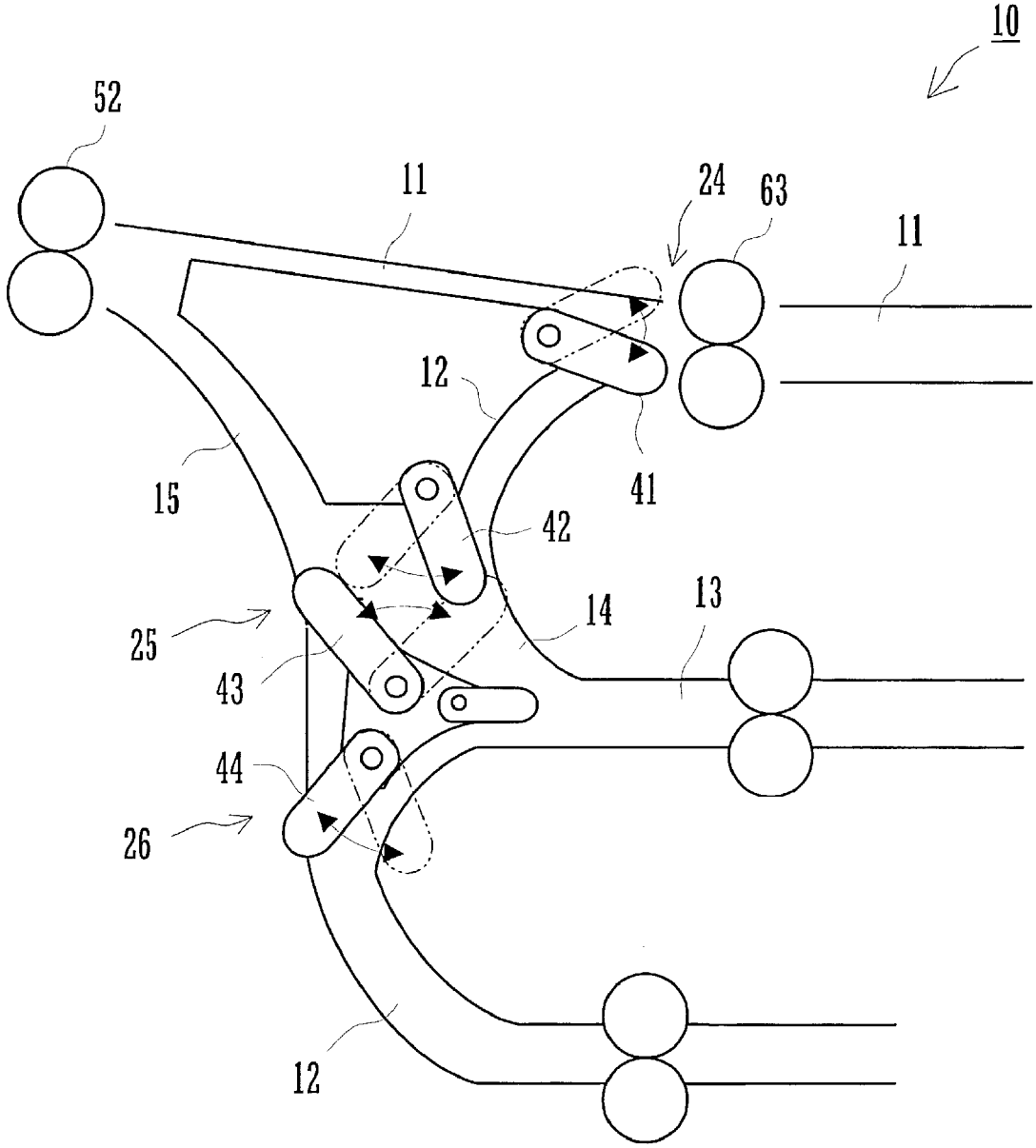
FIG. 3 is a diagram illustrating a configuration of each of first, second, and third bifurcation s of the sheet transport path.

FIG. 3 is a diagram illustrating a configuration of each of the first bifurcation 24, the second bifurcation 25, and the third bifurcation 26, of the sheet transport path 10. A guide 41 is provided at the bifurcation 24. The guide 41 is pivoted between two respective positions indicated by a solid line and a chain double-dashed line by a first solenoid (not shown), to guide a sheet from the bifurcation 24 into either one of the paths 11 and 12.

Guides 42 and 43 are provided at the bifurcation 25. With no external force acting thereon, the guide 42 is located in a position, indicated by a solid line, to guide a sheet into the path 15 as the sheet is transported upward along the path 12 or the path 14. The guide 42 prevents a sheet from being guided into the path 12 as the sheet is transported upward along the path 12 or the path 13.

The guide 43 is pivoted between two respective positions indicated by a solid line and a chain double-dashed line by activating and deactivating a second solenoid (not shown), to allow, in the bifurcation 25, passage of a sheet from the path 14 to the path 15 or from the path 12 to the path 15.

The guide 42 is pivoted to a position indicated by a chain double-dashed line, by contact with a sheet that is transported downward from the bifurcation 24 along the path 12.

A guide 44 is provided at the bifurcation 26. A sheet reversed in the section 12A is never delivered to the tray 38 through the paths 12 and 15. Thus, the roller 58 is rotatable in one direction only, and the guide 44 is urged to a position indicated by a solid line by an elastic member. The elastic member exerts such an elastic force on the guide 44 as to allow the guide 44 to be pivoted to a position indicated by a chain double-dashed line by contact with a sheet that is transported to the portion 12A through the paths 11 and 12. In the bifurcation 26, accordingly, the guide 44 selectively allows passage of a sheet from the path 12 to the path 13, or through the path 12.

Figure 4:
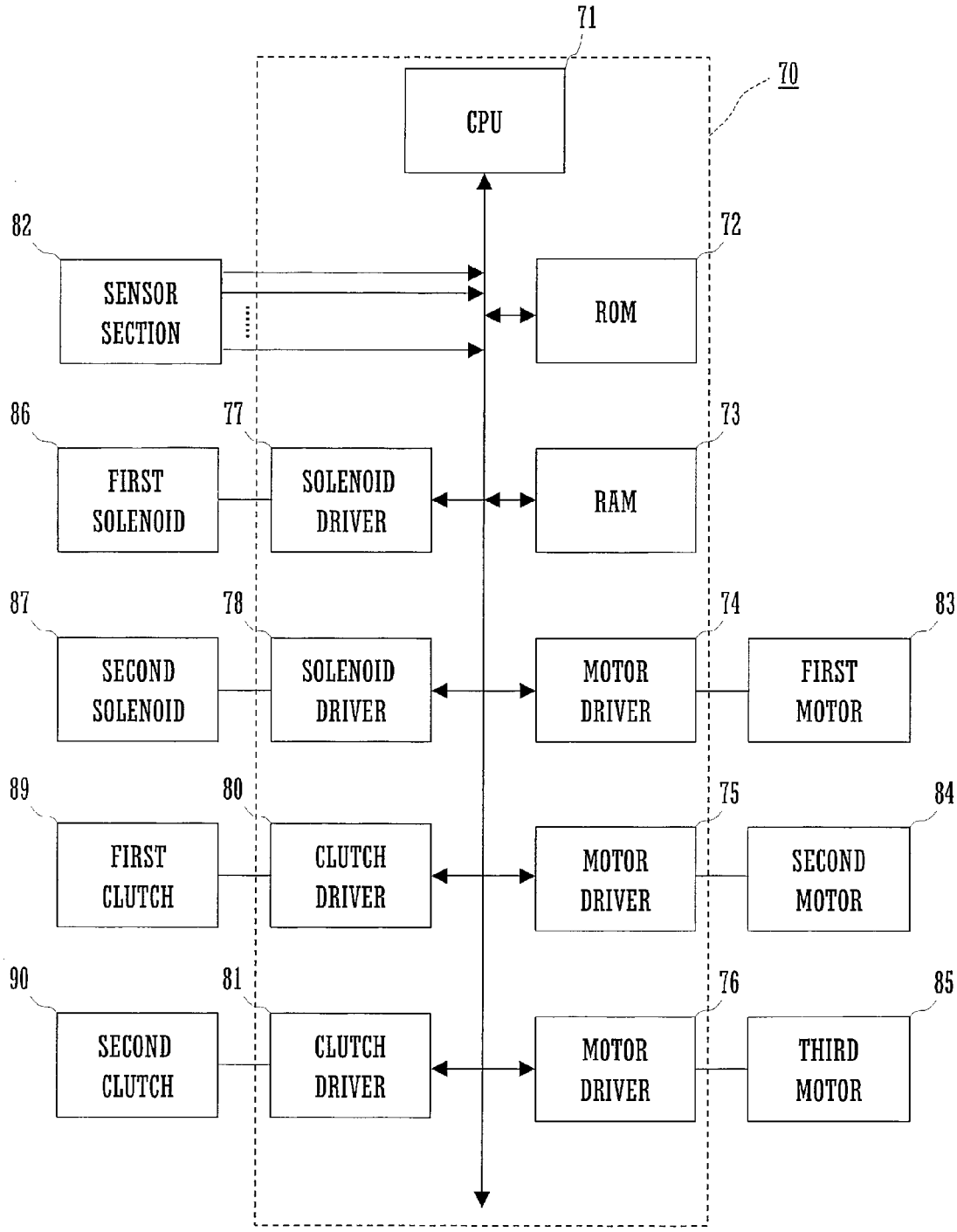
FIG. 4 is a block diagram illustrating a configuration of a control section provided in the apparatus.

FIG. 4 is a block diagram illustrating a configuration of a control section 70 provided in the apparatus 100. The control section 70 has a CPU 71 provided with a ROM 72 and a RAM 73. To the CPU 71 connected are motor drivers 74, 75, and 76, solenoid drivers 77 and 78, clutch drivers 80 and 81, and a sensor section 82.

The section 82 has a plurality of sensors arranged in the sheet transport path 10. Each of the sensors detects presence of a sheet at different locations in the path 10 and inputs a detection signal to the CPU 71.

According to the signal input by the section 82, the CPU 71 executes a program prewritten in the ROM 72 and outputs a driving signal to each of the motor drivers 74, 75, and 76, the solenoid drivers 77 and 78, and the clutch drivers 80 and 81.

To the drivers 74, 75, and 76 connected are a first motor 83, a second motor 84, and a third motor 85, respectively. The drivers 74, 75, and 76 drive the motors 83, 84, and 85, respectively, according to a driving signal from the CPU 71.

To the drivers 77 and 78 connected are a first solenoid 86 and a second solenoid 87, respectively. The drivers 77 and 78 activate the solenoids 86 and 87, respectively, according to a driving signal from the CPU 71.

In a deactivated state, the solenoid 86 puts the guide 41 in the position indicated by the solid line as shown in FIG. 3. In an activated state, the solenoid 86 puts the guide 41 in the position indicated by the chain double-dashed line. More specifically, the guide 41 guides a sheet from the bifurcation 24 into the path 11 with the solenoid 86 in the deactivated state, whereas the guide 41 guides a sheet from the bifurcation 24 into the path 12 with the solenoid 86 in the activated state.

It is to be noted that either of the respective positions indicated by the solid line and the chain double-dashed line as in FIG. 3 can be arbitrarily selected as an initial position of the guide 41 in the deactivated state. Thus, the guide 41 can be placed in an appropriate position for face-up or face-down sheet output, depending on which of the face-up or face-down sheet output a user more often uses.

In a deactivated state, the solenoid 87 puts the guide 43 in the position indicated by the solid line as shown in FIG. 3. In an activated state, the solenoid 87 puts the guide 43 in the position indicated by the chain double-dashed line. More specifically, the guide 43 guides a sheet from the bifurcation 25 into the path 13, and from the path 14 into the path 15, with the solenoid 86 in the deactivated state, whereas the guide 43 guides a sheet from the bifurcation 25 into the path 12, and from the path 12 into the path 15, with the solenoid 87 in the activated state.

To the clutch drivers 80 and 81 connected are a first clutch 89 and a second clutch 90, respectively. The drivers 80 and 81 activate the clutches 89 and 90, respectively, according to a driving signal from the CPU 71.

In a deactivated state, the clutch 89 directly transmits rotation of the second motor 84 to the reversing rollers 53 and 58. In an activated state, the clutch 89 transmits, to the rollers 53 and 58, rotation in an opposite direction to a rotational direction of the motor 84. More specifically, the rollers 53 and 58 are rotated in a forward direction to guide a sheet into the switchback section 12A, with the clutch 89 deactivated. Meanwhile, the rollers 53 and 58 are rotated in a reverse direction to guide a sheet from the section 12A to the bifurcation 25, with the clutch 89 activated.

In a deactivated state, the clutch 90 directly transmits rotation of the third motor 85 to the reversing rollers 55, 56, and 57. In an activated state, the clutch 90 transmits, the rollers 55 to 57, rotation in an opposite direction to a rotational direction of the motor 84. More specifically, the rollers 55 to 57 are rotated in a forward direction to guide a sheet from the bifurcation 25 into the path 13, with the clutch 90 deactivated. Meanwhile, the rollers 55 to 57 are rotated in a reverse direction to guide a sheet from the path 13 to the bifurcation 25, with the clutch 90 activated.

The apparatus 100 selectively performs a face-up transport operation, a face-down transport operation, and a reversing transport operation. In the face-up transport operation, a sheet with an image recorded on a single side is output to the tray 38, with the image-carrying side facing upward. In the face-down transport operation, a sheet with an image recorded on a single side is output face-down to the tray 38, with the image-carrying side facing downward. The reversing transport operation is performed when an image is to be recorded on both sides of a sheet.

The CPU 71 outputs a driving signal to each of the motor drivers 74 to 76, the solenoid drivers 77 and 78, and the clutch drivers 80 and 81, to activate the first motor 83, the second motor 84, the third motor 85, the first solenoid 86, the second solenoid 87, the first clutch 89, and the second clutch 90, so that a sheet is transported on the path 10 through an appropriate route for either one of the face-up, face-down, and reversing transport operations.

In a situation such as when an operator is to copy an original document on paper, the operator is near the apparatus 100 and ready to check the copied paper. In such a situation, the face-up transport operation is performed.

In the face-up transport operation, the CPU 71 drives the motor 83 through the driver 74. A sheet fed from the sheet feeding unit 400 is transported along the path 11 by rotation of each of the transport rollers 61 to 63, the registration roller 51, and the output roller 52. During passage of the sheet through the image recording section 30, a toner image is transferred and fused on an upper side of the sheet. The sheet is output to the tray 38 with the image-carrying side facing upward.

The CPU 71 starts to transmit rotation of the motor 83 to the roller 51, through a clutch (not shown in the figure), at such a timing that a leading end of the sheet meets a leading end of the toner image formed on the drum 31 in a contact area between the roller 35A and the drum 31.

Figure 5:
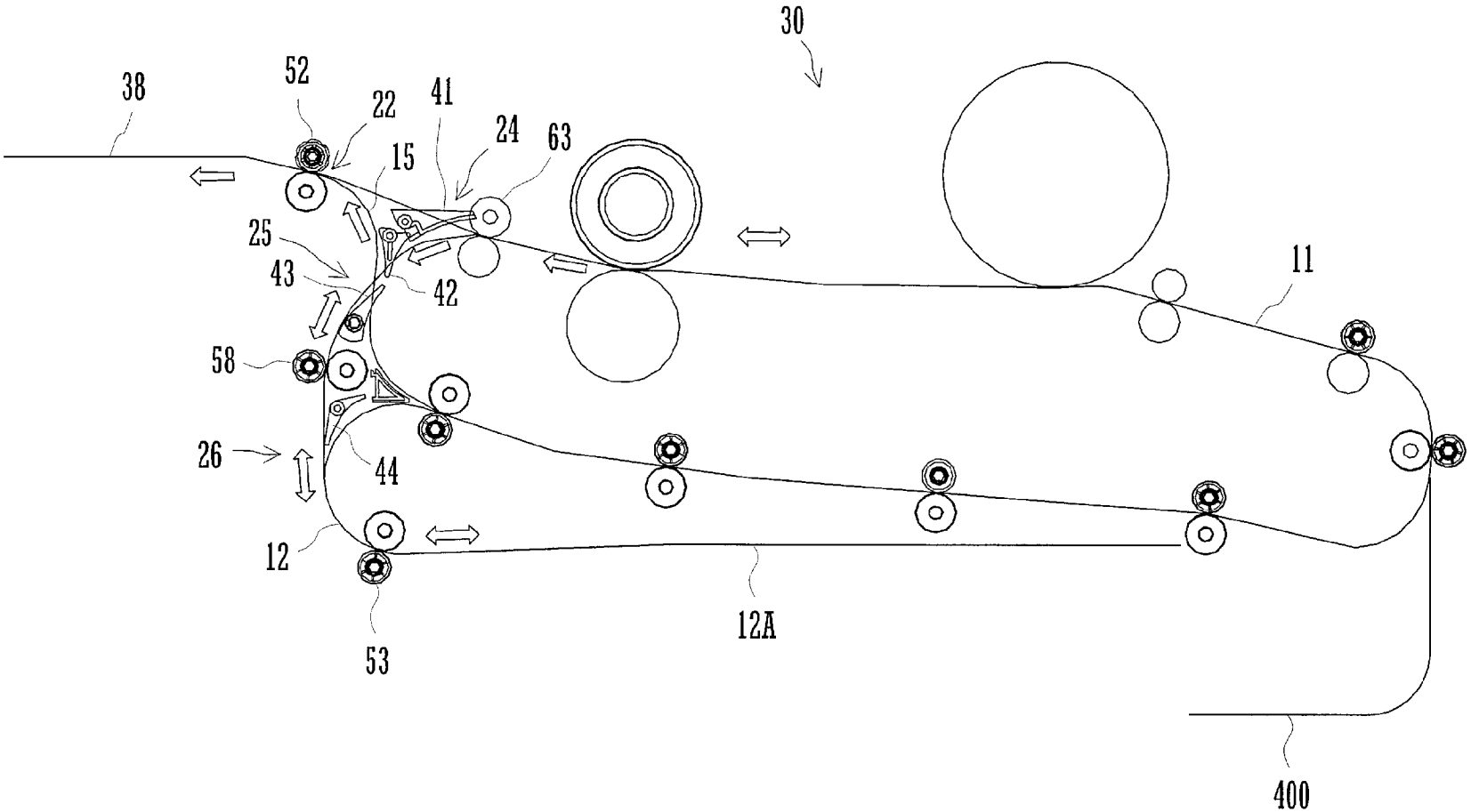
FIG. 5 is a schematic diagram illustrating a first route for a sheet to follow in a face-down transport operation.

FIG. 5 is a schematic diagram illustrating a first route for a sheet to follow in the face-down transport operation. In a situation such as when an image is to be printed on paper according to image data sent from an external device by an operator, the operator is not around the apparatus 100 and therefore not ready to check the printed paper. In such a situation, the face-down transport operation is performed. The face-down transport operation is also performed when images on consecutive pages of an original document are to be recorded on sheets of paper, for the purpose of eliminating the need for collating the recorded sheets.

In the face-down transport operation, the CPU 71 drives the motor 83 through the driver 74 to transport, to the section 30, a sheet fed from the unit 400. The CPU 71 activates the first solenoid 86 and the second solenoid 87 through the solenoid drivers 77 and 78 before a leading end of the sheet reaches the first bifurcation 24. Thus, the guides 41, 43, and 44 are put in the respective positions indicated by the chain double-dashed lines as in FIG. 3, so that the sheet is guided from the bifurcation 24 into the path 12 after passing through the section 30.

The CPU 71 drives the second motor 84 through the motor driver 75 by the time the leading end of the sheet passes through the second bifurcation 25. At the time, the first clutch 89 is not activated. Thus, the reversing rollers 53 and 58 are rotated in the forward directions.

Consequently, the sheet is transported along the path 12 toward the switchback section 12A. It is to be noted that the guide 42 is pivoted to the position indicated by the chain double-dashed line by contact with the leading end of the sheet as the sheet is transported downward through the bifurcation 25, thereby allowing passage of the sheet through the path 12.

As the sheet is transported downward through the third bifurcation26, a tail end of the sheet becomes nipped by the reversing roller 53. It is when the CPU 71 activates the clutch 89 through the clutch driver 80. Thus, the rollers 53 and 58 are rotated in the reverse directions. With the tail end leading, the sheet is transported upward from the section 12A along the path 12, and is guided into the path 15 at the bifurcation 25. Then, the sheet is guided into the path 11 at the second confluence 22, and is output to the tray 38, with the image-carrying side facing downward, by the roller 52.

Figure 6:
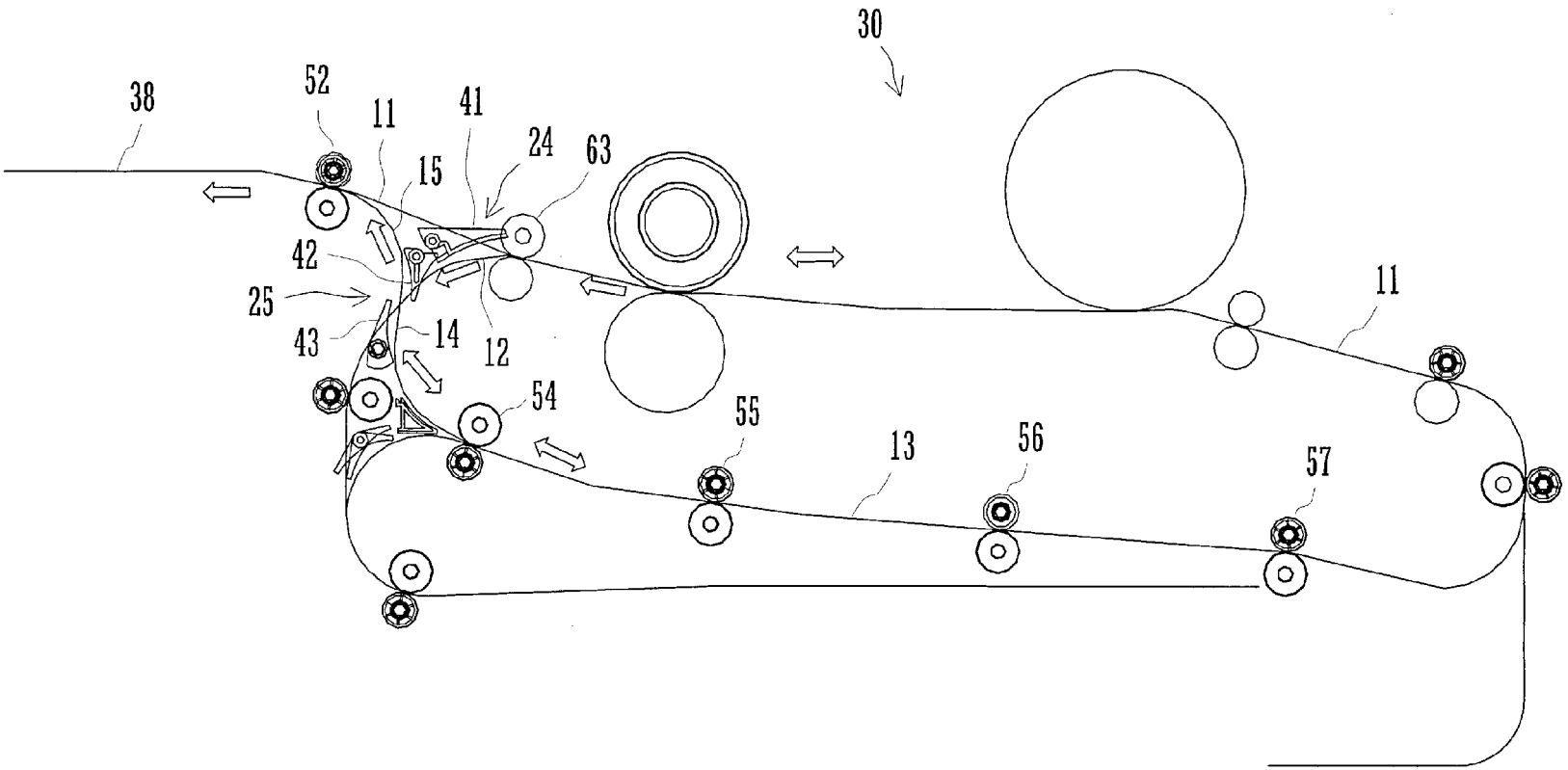
FIG. 6 is a schematic diagram illustrating a second route for a sheet to follow in a face-down transport operation.

FIG. 6 is a schematic diagram illustrating a second route for a sheet to follow in the face-down transport operation. The CPU 71 drives the motor 83 through the driver 74 to transport, to the section 30, a sheet fed from the unit 400. The CPU 71 activates the first solenoid 86 through the solenoid driver 77 before a leading end of the sheet reaches the bifurcation 24. Thus, the guide 41 is put in the position indicated by the chain double-dashed line as in FIG. 3, so that the sheet is guided from the bifurcation 24 into the path 12 after passing through the section 30. It is to be noted that the guide 42 is pivoted to the position indicated by the chain double-dashed line by contact with the leading end of the sheet as the sheet is transported downward through the bifurcation 25, thereby allowing passage of the sheet through the path 12.

At the time, the second solenoid 87 is not activated. Thus, the guides 43 and 44 are put in the respective positions indicated by the solid lines as in FIG. 3, so that the sheet is guided from the path 12 into the path 14 at the bifurcation 25.

The CPU 71 drives the third solenoid 85 through the motor driver 76 by the time the leading end of the sheet passes through the bifurcation 25. At the time, the clutch 89 is not activated. Thus, the reversing rollers 54, 55, 56, and 57 are rotated in the forward directions, so that the sheet is guided from the path 14 into the path 13.

As the sheet is transported downward along the path 14, a tail end of the sheet becomes nipped by the roller 54. It is when the CPU 71 activates the second clutch 90 through the clutch driver 81. Thus, the reversing rollers 54, 55, 56, and 57 are rotated in the reverse directions. With the tail end leading, the sheet is transported, upward from the path 13, along the path 14 and is guided into the path 15 at the bifurcation 25. Then, the sheet is guided into the path 11 at the second confluence 22, and is output to the tray 38, with the image-carrying side facing downward, by the roller 52.

Figure 7:
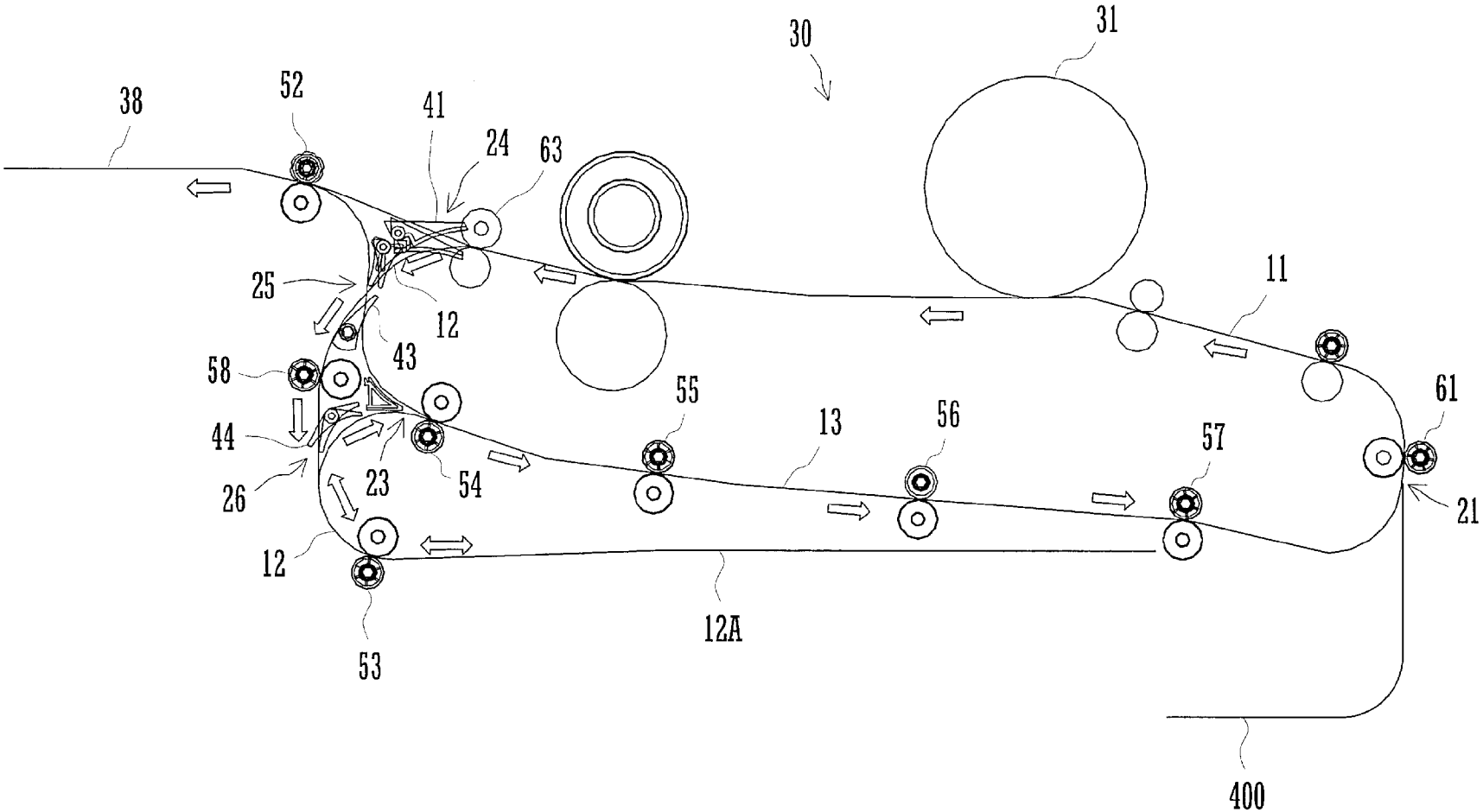
FIG. 7 is a schematic diagram illustrating a route for a sheet to follow in a reverse transport operation.

FIG. 7 is a schematic diagram illustrating a route for a sheet to follow in the reverse transport operation. The reverse transport operation is performed when an image is to be recorded on both sides of a sheet. In the reverse transport operation, an image is recorded on a first side of the sheet in the section 30; the sheet is reversed and returned to the section 30 where an image is recorded on a second side of the sheet; and then, the sheet is output to the tray 38.

In the reverse transport operation, the CPU 71 drives the motor 83 through the driver 74 to transport, to the section 30, a sheet fed from the unit 400. The CPU 71 activates the first solenoid 86 and the second solenoid 87 through the solenoid drivers 77 and 78 before a leading end of the sheet reaches the bifurcation 24. Thus, the guides 41, 43, and 44 are put in the respective positions indicated by the chain double-dashed lines as in FIG. 3, so that the sheet is guided from the bifurcation 24 into the path 12 after an image is formed on a first side o the sheet in the section 30.

The CPU 71 drives the second motor 84 through the motor driver 75 by the time the leading end of the sheet passes through the bifurcation 25. At the time, the first clutch 89 is not activated. Thus, the reversing rollers 53 and 58 are rotated in the forward directions.

Consequently, the sheet is transported along the path 12 toward the switchback section 12A. It is to be noted that the guide 42 is pivoted to the position indicated by the chain double-dashed line by contact with the leading end of the sheet as the sheet is transported downward through the bifurcation 25, thereby allowing passage of the sheet through the path 12.

As the sheet is transported downward through the bifurcation 26, a tail end of the sheet becomes nipped by the reversing roller 53. It is when the CPU 71 activates the clutch 89 through the clutch driver 80 and, at the same time, deactivates the solenoid 87. Further, the CPU 71 drives the motor 85 through the driver 76. At the time, the clutch 90 is not activated. Thus, the rollers 53 and 58 are rotated in the reverse directions, while the guide 44 is put in the position indicated by the solid line as in FIG. 3 and the rollers 54, 55, 56, and 57 are rotated in the forward directions.

With the tail end leading, the sheet is transported, upward from the section 12A, along the path 12 and is guided into the path 13 at the bifurcation 26. Next, the sheet is transported along the path 13 toward the first confluence 21. Then, the sheet is guided into the path 11 at the confluence 21, and is transported along the path 11 to the section 30 with a second side facing the drum 31.

By the time the leading end of the sheet with the second side facing upward passes through the section 30, the CPU 71 deactivates the solenoid 86. Thus, the guide 41 is put in the position indicated by the solid line as in FIG. 3. After an image is recorded on the second side in the section 30, the sheet is transported through the bifurcation 24 and output to the tray 38 by the roller 52.

It is to be noted that the path leading from the bifurcation 24 to the confluence 21 through the paths 12 and 13 in the reverse transport operation corresponds to the second path of the invention as the reversing transport path.

Figure 8:
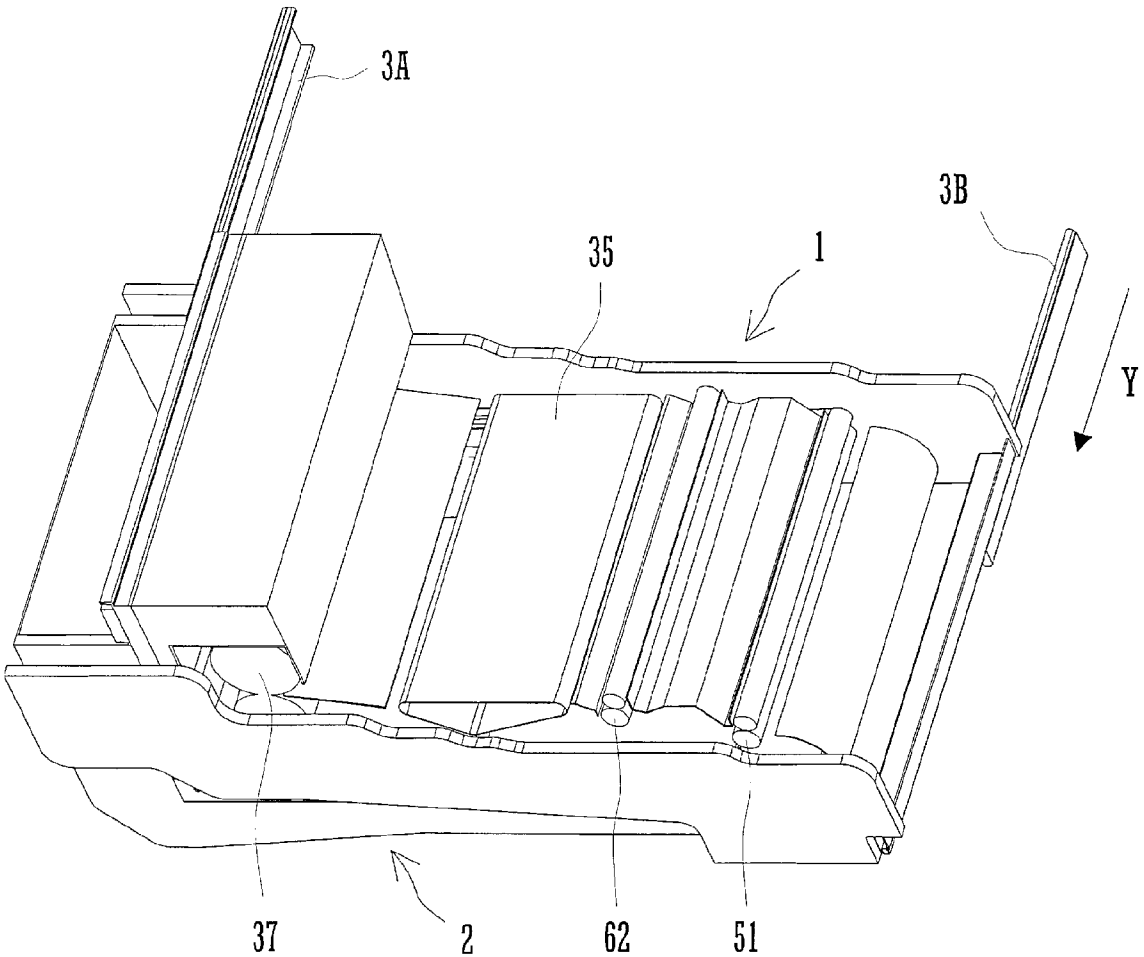
FIG. 8 is an external view of the apparatus illustrating a first unit, and a second unit, as detached from the apparatus.
Figure 9:
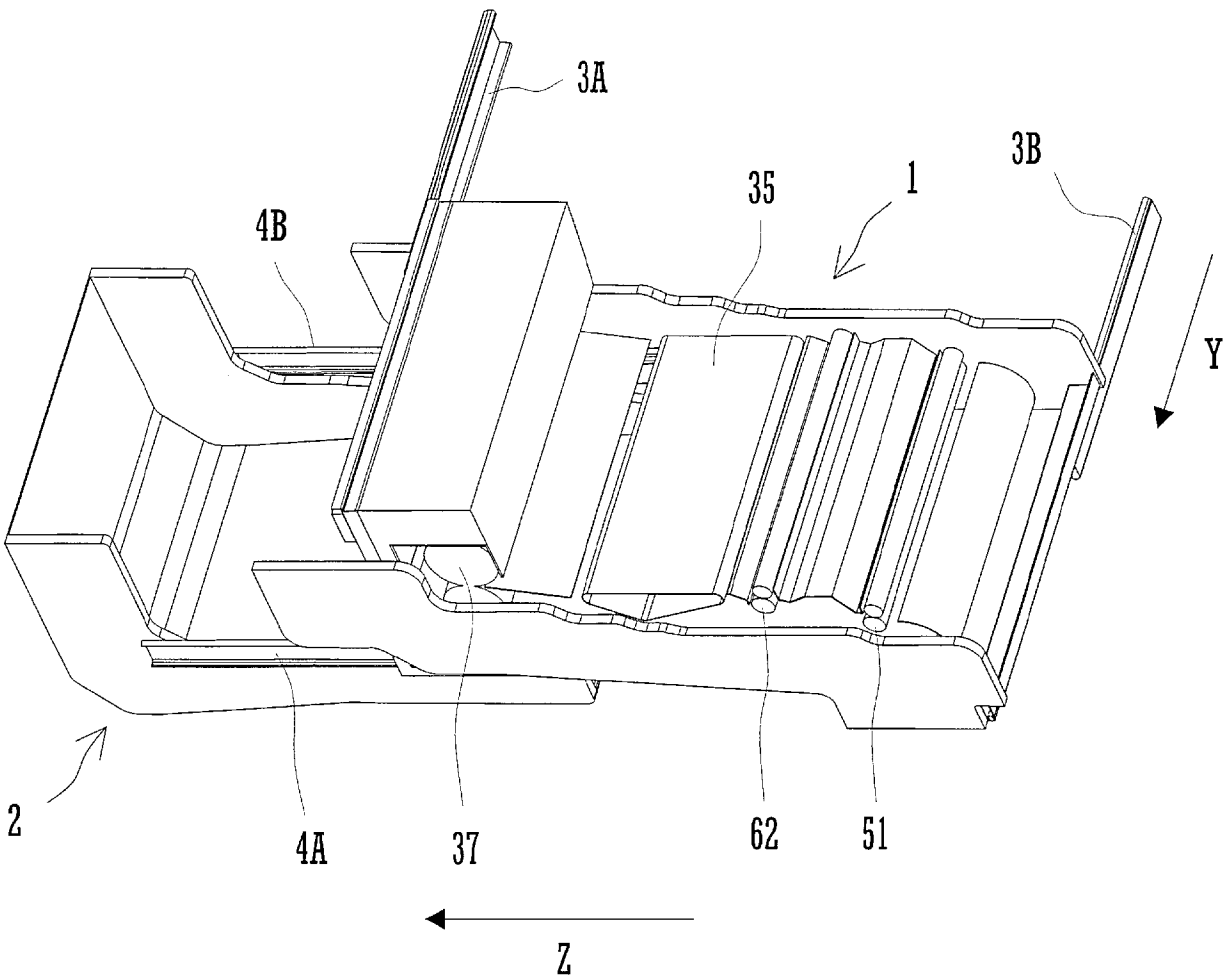
FIG. 9 is an external view of the apparatus illustrating a second unit detached from the first unit.

FIG. 8 is an external view of the apparatus 100 illustrating a first unit 1, and a second unit 2, as detached from the apparatus 100. The apparatus 100 includes a first unit 1 and a second unit 2. The first unit 1 has the transfer belt 35, the transfer roller 35A, and the fusing device 37 positioned therein. The unit 1 is slidably supported by sliding rails 3A and 3B. The unit 1 can be detached from the apparatus 100 by being moved in a direction of arrow Y toward the front (i.e., the outside) of the apparatus 100. The direction of arrow Y corresponds to the first direction of the invention.

Figure 10:
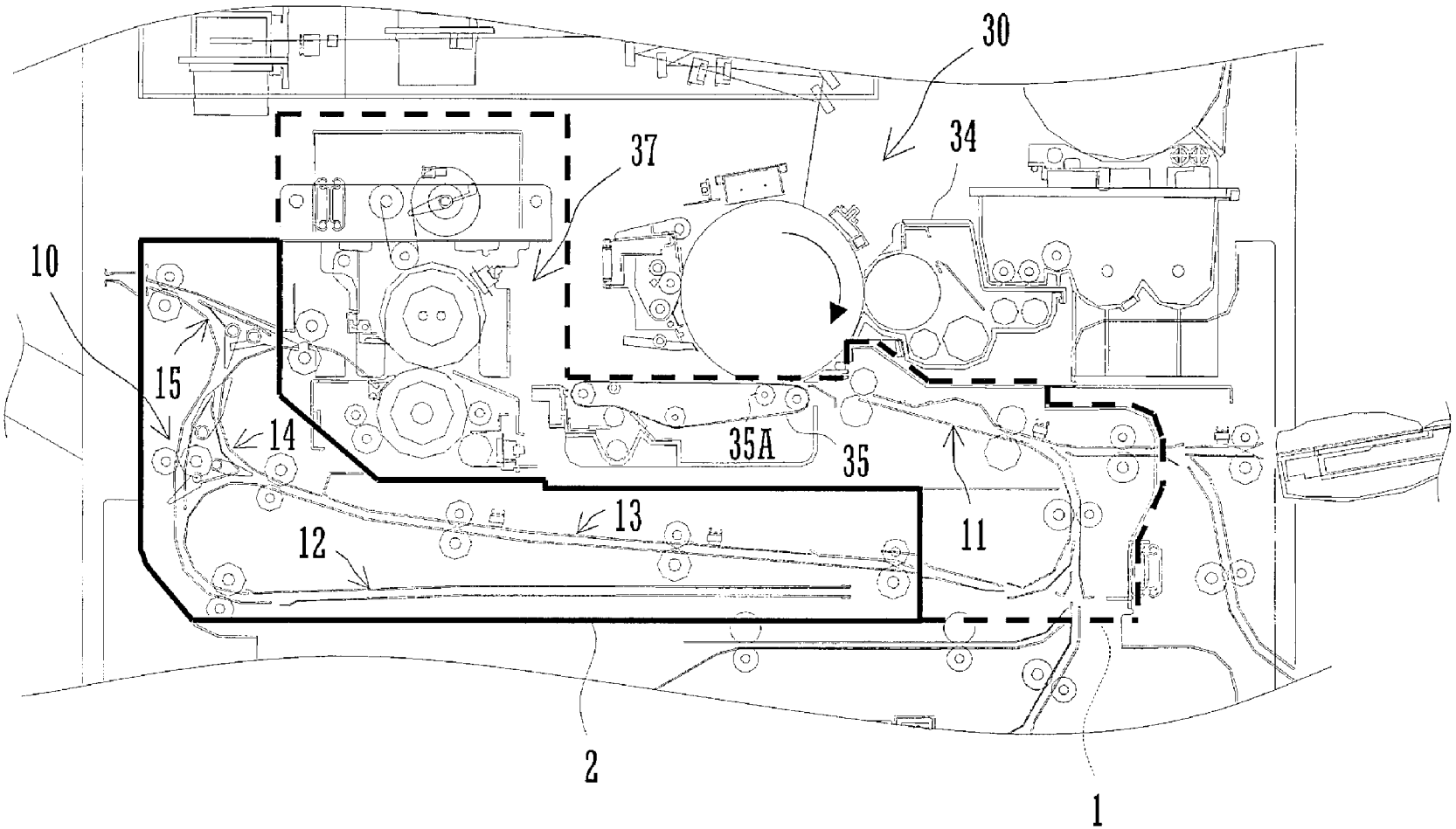
FIG. 10 is a partial enlarged view of the apparatus.

In the unit 1, referring to FIG. 10, the portion of the first path 11 located in the section 30, and a portion of the third path 13, are positioned. When the unit 1 is detached from the apparatus 100, the portion of the path 11 located in the section 30 is exposed, as shown in FIG. 8. In the event of sheet jam or the like, thus, a user can easily check whether a sheet is present or absent in the portion, and, if necessary, remove a sheet present in the portion, by merely detaching the unit 1 from the apparatus 100.

Referring to FIG. 10, the second unit 2 has a portion of the path 11, the entire path 12, a portion of the path 13, the entire path 14, and the entire path 15 positioned therein. The unit 2 is slidably supported by sliding rails 4A and 4B. With the unit 1 detached from the apparatus 100 as in FIG. 8, the unit 2 can be detached from the unit 1 by being moved in a direction of arrow Z. The direction of arrow Z is perpendicular to the direction of arrow Y.

Figure 11:
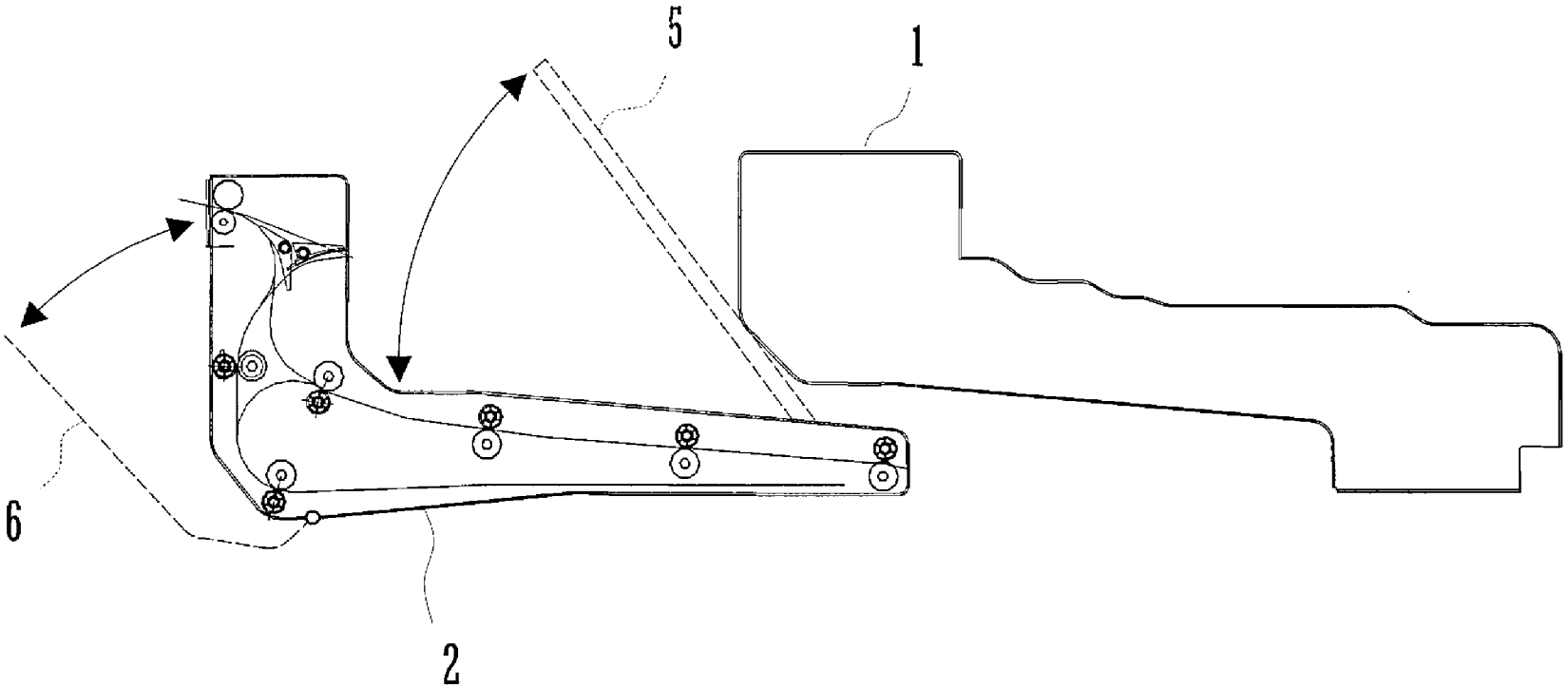
FIG. 11 is a schematic drawing illustrating a configuration of the second unit.

The unit 2 has an upper movable plate 5 and a side movable plate 6. With the unit 2 detached from the unit 1, referring to FIG. 11, each of the plates 5 and 6 is rendered pivotable between a closed position and an open position indicated by a solid line and a broken line, respectively. The plates 5 and 6 are pivoted to the open positions to expose a portion of the path 12 and a portion of the path 13.

A sheet jam is relatively more likely Lo occur in the first bifurcation 24, the second bifurcation 25, and the third bifurcation 26, which are arranged in the order along the portion of the path 12. The plate 6 is pivoted to the open position to expose all of the points 24 to 26 to the outside and provide access to the points 24 to 26. This facilitates removal of a sheet present in the paths 12 and 13 in the event of a sheet jam.

Thus, this configuration improves accessibility to portions of the sheet transport path where a sheet jam is more likely to occur, thereby lightening the workload for a user.

Also, with the unit 2 detached from the unit 1, the upper and side surfaces of the unit 2 are rendered openable. This configuration allows the upper and side surfaces to be opened more widely, and therefore enables a portion of the sheet transport path 10 to have a greater exposed area, than a conventional configuration where the unit 1 and the unit 2 are integrated in a single unit.

This configuration improves workability in removing a sheet from the path 10. This configuration also allows a smaller number of portions of the unit 2 of which upper surfaces are to be opened to check if any sheet is present on the path 10. Thus, this configuration lightens the workload for a user.

Furthermore, the unit 2 is moved out of the unit 1 along the direction of arrow Z, instead of along the direction of arrow Y. This configuration eliminates the need for provision of additional space for moving the unit 2 out of the unit 1 along the direction of arrow Y. It is not necessary to provide a dedicated space for moving the unit 2 out of the unit 1 along the direction of arrow Z, since space for a user to remove a printed sheet also serves as the space for moving the unit 2 out of the unit 1. This simple configuration contributes to minimizing space for the apparatus 100 to be placed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image recording apparatus, comprising:

a sheet transport path for guiding a sheet from a sheet feeding section, through an image recording section, to a sheet output section, the sheet transport path including a first path and a second path;

a first unit mounted detachably in a housing, the first unit being detached from the housing by being moved in a first direction toward front of the housing, the first path being positioned in the first unit; and a second unit mounted detachably in the first unit, the second unit being detached from the first unit by being moved in a second direction perpendicular to the first direction with the first unit detached from the housing, the second path being positioned in the second unit.

2. The image recording apparatus according to claim 1, wherein the image recording section has a plurality of components, and wherein the first unit has at least part of the components arranged therein.

3. The image recording apparatus according to claim 1, wherein the second path is a reversing transport path for guiding a sheet, after the sheet passes through the image recording section, back to the image recording section while turning the sheet upside down.

4. The image recording apparatus according to claim 1, wherein the second unit has an upper surface and a side surface, the upper and side surfaces being rendered openable and closable with the second unit detached from the first unit.

5. The image recording apparatus according to claim 1, wherein the image recording section is an electrophotographic image recording apparatus provided with at least a transfer device and a fusing device, and wherein the first unit has the transfer device, and the fusing device, positioned therein.

* * * * *